US006032954A

United States Patent [19]

Fotter

[11] Patent Number: 6,032,954

[45] Date of Patent: Mar. 7, 2000

[54] BASEBALL GAME

[76] Inventor: Peter D. Fotter, R.R. 3 Box 2257, Oakland, Me. 04963

[21] Appl. No.: 09/061,160

[22] Filed: Apr. 16, 1998

[51] Int. Cl.[7] ..... A63F 7/06; A63F 7/20

[52] U.S. Cl. ..... 273/108.3; 273/123 R

[58] Field of Search ..... 273/108.3, 108.31, 273/108.32, 108.33, 244.1, 244.2, 259, 277, 317.6, 317.7, 317.8, 317.9, 123 R, 126 R; D21/315, 339, 355, 356

[56] References Cited

U.S. PATENT DOCUMENTS

| | | |
|---|---|---|
| 945,511 | 1/1910 | Garbarino . |
| 968,249 | 8/1910 | Meeker . |
| 1,298,591 | 3/1919 | Smith . |
| 1,403,402 | 1/1922 | Grasso . |
| 2,234,725 | 3/1941 | Doerr . |
| 2,462,170 | 2/1949 | Dube . |
| 4,017,074 | 4/1977 | Roberts . |
| 5,183,266 | 2/1993 | Kohler . |

*Primary Examiner*—Sebastiano Passaniti

[57] ABSTRACT

A baseball game apparatus is provided including a playing board including a bottom face, a top face, a periphery, and a side wall extending upwardly from the periphery. The top face has a diamond-shaped playing field with an infield portion and an outfield portion. Each portion has a plurality of hole recesses formed therein with indicia situated adjacent thereto. The top face is downwardly sloped from the outfield portion to the infield portion and further has a dish-shaped recesses surrounding each of the cylindrical hole recesses. Also included is a ball for rolling on the top face of the playing board.

13 Claims, 2 Drawing Sheets

BASEBALL GAME

BACKGROUND OF THE INVENTION

1. Field of the Invention

The present invention relates to baseball board games and more particularly pertains to a new baseball game for simulating a game of baseball.

2. Description of the Prior Art

The use of baseball board games is known in the prior art. More specifically, baseball board games heretofore devised and utilized are known to consist basically of familiar, expected and obvious structural configurations, notwithstanding the myriad of designs encompassed by the crowded prior art which have been developed for the fulfillment of countless objectives and requirements.

Known prior art baseball board games include U.S. Pat. No. 5,183,266; U.S. Pat. No. 5,125,658; U.S. Pat. No. 4,976,434; U.S. Pat. No. 4,602,786; U.S. Pat. Des. 340,746; and U.S. Pat. Des. 343,645.

In these respects, the baseball game according to the present invention substantially departs from the conventional concepts and designs of the prior art, and in so doing provides an apparatus primarily developed for the purpose of simulating a game of baseball.

SUMMARY OF THE INVENTION

In view of the foregoing disadvantages inherent in the known types of baseball board games now present in the prior art, the present invention provides a new baseball game construction wherein the same can be utilized for simulating a game of baseball.

The general purpose of the present invention, which will be described subsequently in greater detail, is to provide a new baseball game apparatus and method which has many of the advantages of the baseball board games mentioned heretofore and many novel features that result in a new baseball game which is not anticipated, rendered obvious, suggested, or even implied by any of the prior art baseball board games, either alone or in any combination thereof.

To attain this, the present invention generally comprises a playing board having a horizontally oriented bottom face, a top face, an octagon-shaped periphery, and a side wall. The top face has a diamond-shaped playing field with an infield portion, an outfield portion, and a foul ball portion, as shown in FIG. 1. Each portion of the playing field has a plurality of vertically oriented cylindrical hole recesses formed therein with indicia situated adjacent thereto. The top face is downwardly sloped from the outfield portion to the infield portion and further has dish-shaped recesses surrounding each of the cylindrical hole recesses for reasons that will become apparent hereinafter. For keeping track of a score and a current inning, the side wall has a plurality of linearly aligned peg holes formed therein adjacent to the outfield portion of the playing field. The top face of the playing board has a plurality of linearly aligned peg holes formed therein between the infield and outfield portions of the playing field. These peg holes are adapted for keeping track of a number of current balls, strikes, runs and outs. A portion of the side wall that resides adjacent to the outfield portion of the playing field includes a home run section. Also included is a ball for rolling on the top face of the playing board. Next provided is a miniature bat for striking the ball along the top face of the playing board. A plurality of defensive player figurines are each situated on the playing board adjacent to an associated one of the cylindrical hole recesses. Finally, a plurality of stoppers each include a block mounted on the top face of the playing board. As shown in FIG. 1, each block includes an arcuate surface facing the side wall of the periphery surrounding the outfield portion of the playing field.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new baseball game apparatus and method which has many of the advantages of the baseball board games mentioned heretofore and many novel features that result in a new baseball game which is not anticipated, rendered obvious, suggested, or even implied by any of the prior art baseball board games, either alone or in any combination thereof.

It is another object of the present invention to provide a new baseball game which may be easily and efficiently manufactured and marketed.

It is a further object of the present invention to provide a new baseball game which is of a durable and reliable construction.

An even further object of the present invention is to provide a new baseball game which is susceptible of a low cost of manufacture with regard to both materials and labor, and which accordingly is then susceptible of low prices of sale to the consuming public, thereby making such baseball game economically available to the buying public.

Still yet another object of the present invention is to provide a new baseball game which provides in the apparatuses and methods of the prior art some of the advantages thereof, while simultaneously overcoming some of the disadvantages normally associated therewith.

Still another object of the present invention is to provide a new baseball game for providing entertainment.

Even still another object of the present invention is to provide a new baseball game that includes a playing board having a bottom face, a top face, a periphery, and a side wall extending upwardly from the periphery. The top face has a diamond-shaped playing field with an infield portion and an outfield portion. Each portion has a plurality of hole recesses formed therein with indicia situated adjacent thereto. The top face is downwardly sloped from the outfield portion to the infield portion and further has a dish-shaped recesses surrounding each of the cylindrical hole recesses. Also included is a ball for rolling on the top face of the playing board.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
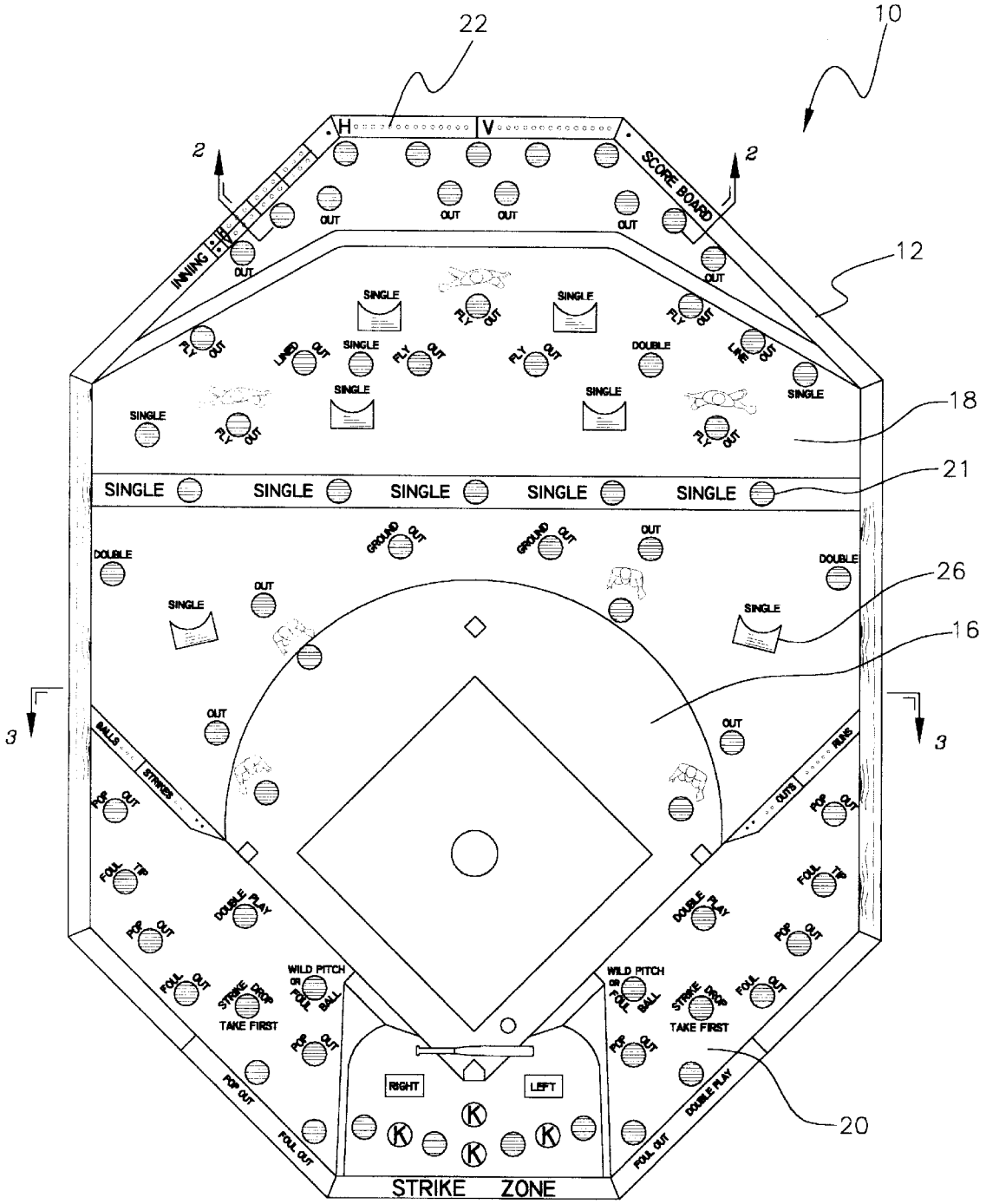
FIG. 1 is a top view of a new baseball game according to the present invention.
Figure 2:
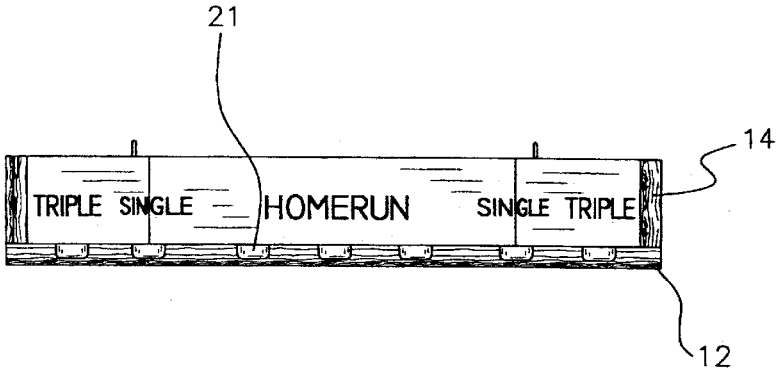
FIG. 2 is a cross-sectional view of the present invention taken along line 2—2 shown in FIG. 1.
Figure 3:
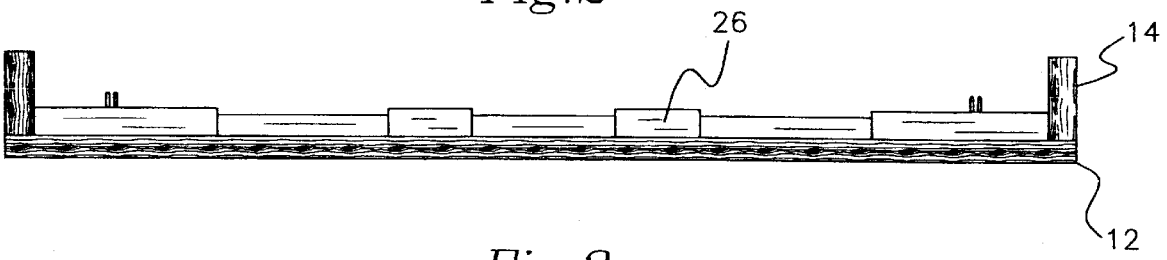
FIG. 3 is a cross-sectional view of the present invention taken along line 3—3 shown in FIG. 1.
Figure 4:
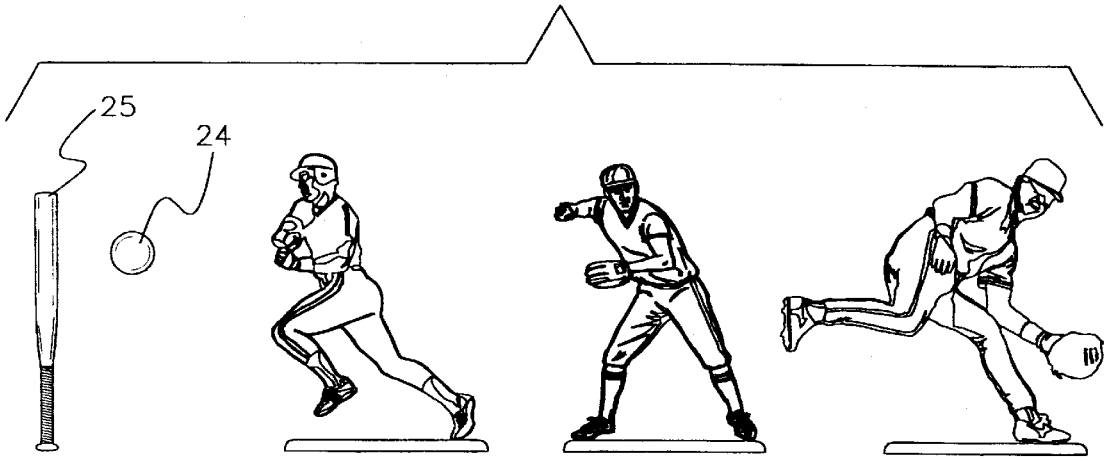
FIG. 4 is a perspective view of the various components of the present invention.

With reference now to the drawings, and in particular to FIGS. 1 through 4 thereof, a new baseball game embodying the principles and concepts of the present invention and generally designated by the reference numeral 10 will be described.

The present invention, designated as numeral 10, includes a 1:90 scaled playing board 12 having a horizontally oriented bottom face, a top face, an octagon-shaped periphery, and a side wall 14. Such side wall extends upwardly constant a height with an exception of a diminished portion adjacent to a home-plate section. As will soon become apparent, this allows more room for a batter. The top face has a diamond-shaped playing field with an infield portion 16, an outfield portion 18, and a foul ball portion 20. Further portions include a square batter box portion and a generally crescent-shaped rear peripheral portion. The outfield and foul ball portions are preferably separated by elevated strips which simulate foul lines. Similarly, the infield portion and outer edges of the batter box portion are also separated by elevated strips of a 3 inch length which act as pitching bumpers. The foregoing elevated strips preferably extend upwardly about 1 inch. The pitching bumpers not only direct the ball toward the batters box, but are also used for variations in pitching styles. It should be noted that the indicia also distinguishes between each of the portions.

Each portion of the playing field has a plurality of vertically oriented cylindrical hole recesses 21 formed therein with indicia situated adjacent thereto. The indicia of the rear peripheral portion includes "out" indicia. The outfield portion includes "double", "out", "ground out", "fly out", "line out" and "single" indicia. As shown in FIG. 1, the hole recesses with "single" indicia are laterally aligned. "Pop out", "foul tip", "double play", "wild pitch or foul ball", "strike drop" and "foul out" indicia are printed on the foul portions.

The top face is downwardly sloped from the outfield portion to the infield portion and batter box portion and further has dish-shaped recesses surrounding each of the cylindrical hole recesses for reasons that will become apparent hereinafter. For keeping track of a score and a current inning, the side wall has a plurality of linearly aligned peg holes 22 formed therein adjacent to the outfield portion of the playing field. The top face of the playing board has a plurality of linearly aligned peg holes formed in the foul lines between the infield and outfield portions of the playing field. These peg holes are adapted for keeping track of a number of current balls, strikes, runs and outs with a plurality of pegs. A portion of the side wall that resides adjacent to the outfield portion of the playing field includes a home run section, a single section, and a triple section each marked by indicia on an inner surface thereof. Note FIG. 2.

Also included is a ball 24 for rolling on the top face of the playing board. Next provided is a miniature bat 25 for striking the ball along the top face of the playing board. A plurality of defensive player figurines are each situated on the playing board adjacent to an associated one of the cylindrical hole recesses.

Finally, a plurality of stoppers 26 each include a block mounted on the top face of the playing board. As shown in FIG. 1, each block includes an arcuate surface facing the side wall of the periphery surrounding the outfield portion of the playing field. The arcuate surfaces are adapted for catching the balls. In the preferred embodiment, the blocks each have "single" indicia printed adjacent thereto.

The method associated with the present invention will now be set forth. During play, the ball is first rolled by a player acting as a pitcher. The ball may be directed anywhere in the general direction of the pitching bumpers. Next, the ball is struck with the bat by another player. Depending on which hole recess the ball enters, an offensive runner figurine is moved over bases of the infield in a convention manner. The peg holes facilitate the tracking of runs, etc. A unique feature of the method of play includes awarding a single, triple or home run to a player who hits the ball such that the same circumvents the hole recesses and strikes the corresponding portion of the playing field. It should be noted that at bat, if the ball enters one of the hole recesses of the batter box area, a strike or ball is counted depending on the marking wihtin the hole recess. Note FIG. 1. Finally, if the ball enters a hole recess situated adjacent to one of the defensive players, an out is counted. When playing with multiple players on a team, a wrist band is worn by the player who is next at bat for the following inning. This maintains consistency in batting order and avoid confusion regarding who bats next.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A baseball game apparatus comprising, in combination:

a playing board including a horizontally oriented bottom face, a top face, an elongated octagon-shaped periphery defined by a peripheral wall including a pair of laterally spaced side walls, the top face having a diamond-shaped playing field with an infield portion, an outfield portion, and a foul ball portion, each portion having a plurality of vertically oriented cylindrical hole recesses formed therein with indicia situated adjacent thereto, the top face being downwardly sloped from the outfield portion to the infield portion and further having dish-shaped recesses surrounding each of the cylindrical hole recesses, the side wall having a plurality of linearly aligned peg holes formed therein adjacent to the outfield portion of the playing field for keeping track of a score and a current inning, the top face of the playing board having a plurality of linearly aligned peg holes formed therein between the infield and outfield portions of the playing field for keeping track of a number of current balls, strikes, runs and outs, wherein a portion of the outfield portion of the playing field includes a home run section;

a ball for rolling on the top face of the playing board;

a miniature bat for striking the ball along the top face of the playing board;

a plurality of defensive player figurines each situated on the playing board adjacent to an associated one of the cylindrical hole recesses; and a plurality of stoppers each including a block mounted on the top face of the playing board, each block including an arcuate surface directed away from the infield and being for retaining the ball from moving toward the infield portion upon the ball coming to rest against said arcuate surface, each block including a flat front face being substantially directed towards a home plate area of the infield portion.

2. A baseball game apparatus comprising:

a playing board including a bottom face, a top face, a periphery, and a side wall extending upwardly from the periphery, the top face having a diamond-shaped playing field with an infield portion and an outfield portion, each portion having a plurality of hole recesses formed therein with indicia situated adjacent thereto, the top face being downwardly sloped from the outfield portion to the infield portion and further having dish-shaped recesses surrounding each of the cylindrical hole recesses;

a plurality of stoppers each including a block mounted on the top face of the playing board, each block including an arcuate surface directed away from the infield and being for retaining the ball from moving toward the infield portion upon the ball coming to rest against said arcuate surface, each block including a flat front face being substantially directed towards a home plate area of the infield portion; and a ball for rolling on the top face of the playing board.

3. A baseball game apparatus as set forth in claim 2 wherein playing board has a plurality of linearly aligned peg holes formed therein for keeping track of a score and a current inning.

4. A baseball game apparatus as set forth in claim 2 wherein the playing board has a plurality of linearly aligned peg holes formed therein for keeping track of a number of current balls, strikes, runs and outs.

5. A baseball game apparatus as set forth in claim 2 and further including a miniature bat for striking the ball along the top face of the playing board.

6. A baseball game apparatus as set forth in claim 2 wherein a plurality of defensive player figurines are each situated on the playing board adjacent to an associated one of the hole recesses.

7. A baseball game apparatus as set forth in claim 2 wherein the periphery of the playing field is octagon-shaped.

8. A baseball game apparatus as set forth in claim 2 wherein a pair of pitching bumpers are included for guiding the ball into a batter box portion.

9. A baseball game apparatus as set forth in claim 8 wherein the top face is sloped downwardly to the batter box.

10. A baseball game apparatus as set forth in claim 2 wherein elevated strips separate the outfield portion and infield portion.

11. A baseball game apparatus as set forth in claim 10 wherein the elevated strips have peg holes formed therein.

12. A baseball game apparatus as set forth in claim 2 wherein the side wall has a rear portion with a reduced height.

13. A baseball game method comprising the steps of:

providing a playing board including a horizontally oriented bottom face, a top face, an octagon-shaped periphery, and a side wall, the top face having a diamond-shaped playing field with an infield portion, an outfield portion, and a foul ball portion, each portion having a plurality of vertically oriented cylindrical hole recesses formed therein with indicia situated adjacent thereto, the top face being downwardly sloped from the outfield portion to the infield portion and further having dish-shaped recesses surrounding each of the cylindrical hole recesses, the side wall having a plurality of linearly aligned peg holes formed therein adjacent to the outfield portion of the playing field for keeping track of a score and a current inning, the top face of the playing board having a plurality of linearly aligned peg holes formed therein between the infield and outfield portions of the playing field for keeping track of a number of current balls, strikes, runs and outs, wherein a portion of the side wall being adjacent to the outfield portion of the playing field includes a home run section;

providing a ball for rolling on the top face of the playing board;

providing a miniature bat for striking the ball along the top face of the playing board;

providing a plurality of defensive player figurines each situated on the playing board adjacent to an associated one of the cylindrical hole recesses;

providing a plurality of stoppers each including a block mounted on the top face of the playing board, each block including an arcuate surface directed away from the infield and being for retaining the ball from moving toward the infield portion upon the ball coming to rest against said arcuate surface, each block including a flat front face being substantially directed towards a home plate area of the infield portion;

hitting the ball with the bat from an area behind the infield portion of the playing field to the outfield portion thereof; and awarding a home run to a player who hits the ball such that the same circumvents the hole recesses and strikes the home run portion of the playing field.

* * * * *